US011198601B2

(12) United States Patent
Greenstein

(10) Patent No.: US 11,198,601 B2
(45) Date of Patent: Dec. 14, 2021

(54) CORKSCREW AND BOTTLE OPENER APPARATUS

(71) Applicant: Noah Greenstein, Dobbs Ferry, NY (US)

(72) Inventor: Noah Greenstein, Dobbs Ferry, NY (US)

(73) Assignee: Noah Greenstein

( * ) Notice: Subject to any disclaimer, the term of this patent is extended or adjusted under 35 U.S.C. 154(b) by 368 days.

(21) Appl. No.: 16/538,510

(22) Filed: Aug. 12, 2019

(65) Prior Publication Data

US 2020/0048063 A1 Feb. 13, 2020

Related U.S. Application Data

(60) Provisional application No. 62/718,291, filed on Aug. 13, 2018.

(51) Int. Cl.

| | |
|---|---|
| ***B67B 7/44*** | (2006.01) |
| ***B67B 7/16*** | (2006.01) |
| ***B67B 7/04*** | (2006.01) |

(52) U.S. Cl.

CPC ..... *B67B 7/44* (2013.01); *B67B 7/04* (2013.01); *B67B 7/16* (2013.01)

(58) Field of Classification Search

CPC ..... B67B 7/44; B67B 7/04; B67B 7/16

See application file for complete search history.

(56) References Cited

U.S. PATENT DOCUMENTS 2,458,778 A * 1/1949 Hines ..... B67B 7/44 81/3.45

7,614,322 B1 11/2009 Corredor-Londono

FOREIGN PATENT DOCUMENTS

| | | |
|---|---|---|
| CN | 205575551 U | 9/2016 |
| EP | 2128079 B1 | 5/2013 |

* cited by examiner

*Primary Examiner* — David B. Thomas

(74) *Attorney, Agent, or Firm* — Dechert LLP

(57) ABSTRACT

The present invention is directed to a pocket-sized corkscrew, bottle opener, and key chain combination apparatus that can be used to open corked and capped bottles, which when stored shields the corkscrew tip, and which can be converted from its storage configuration to its corked-bottle opener configuration with requiring disassembly of the pieces of the apparatus.

15 Claims, 4 Drawing Sheets

CORKSCREW AND BOTTLE OPENER APPARATUS

1. FIELD OF INVENTION

Figure 1:
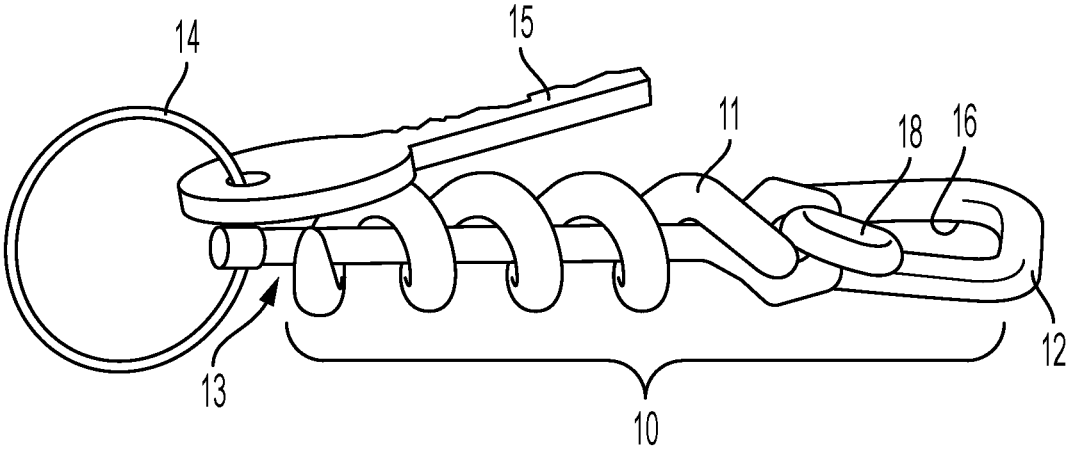

The present invention is directed to a compact pocket-sized combination corkscrew, bottle opener, and key chain apparatus that can be used to open corked and capped bottles.

2. BACKGROUND

Combination corkscrew, bottle opener, and key ring apparatuses are known in the art. But prior art apparatuses often require disassembling and reassembling the apparatus in order to alternate between storage and use modes. Furthermore, combination corkscrew, bottle opener, and key ring apparatuses are also often too large and/or heavy to be considered a pocket-size apparatus that is carried on a daily basis by the user. Examples of representative prior art combination corkscrew, bottle opener, and key ring apparatuses are provided in the following paragraphs.

Chinese Patent Publication No. CN 205575551 describes a dual-purpose bottler opener and key ring, which can open wine and beer bottles, and which shields the tip of the corkscrew when it is not being used. In order to configure this apparatus to use the corkscrew, however, the key ring and corkscrew have to be detached from the rest of the apparatus and then reassembled in a mode that allows use of the corkscrew. To restore the apparatus to its storage configuration, these pieces have to again be disassembled and reassembled.

European Patent No. EP 2,128,079 B1 discloses a combination corkscrew and key ring apparatus, which may optionally also contain a capped bottle opener. The apparatus includes a corkscrew and handle, which are separate pieces that may be attached together for storage by connection through a quick-release or split key ring. To use the corkscrew, however, the corkscrew and handle must be detached from the key ring and reassembled. To restore the apparatus to its storage configuration, these pieces have to be disassembled and reassembled.

A need remains for a compact and lightweight and pocket apparatus that combines a corkscrew, bottle opener, and key ring apparatus that, when stored, shields the tip of the corkscrew so that is not free to puncture materials, and can also be configured for use to remove a cork without requiring disassembling and reassembling the apparatus.

3. SUMMARY

The present application is directed to a compact pocket-sized apparatus with a key ring that can be used to open corked and capped bottles. When the apparatus is stored, the tip of the corkscrew is shielded in a manner that prevents the corkscrew tip from puncturing objects that come into contact with the apparatus when the corkscrew is not in use. By shielding the tip of the corkscrew, the apparatus may be stored in pocket without the corkscrew tip being free to puncture the pocket material.

The apparatus of the present invention can be configured in a manner to open wine bottles, capped bottles (e.g., soda or beer bottles), or for storage, without the need to disassemble and reassemble its components when changing between configurations. Because the components to remain attached, regardless of what configuration the apparatus is in, the apparatus described herein improves upon combined corkscrew, bottle opener, and key ring apparatuses that require disassembly to change between configurations.

Because prior art apparatuses are often too large and/or heavy to be carried with the user on a daily basis, the inventive apparatus also has the advantage of being compact and light. Therefore, this apparatus can be readily transported in the users pocket for daily access and use.

In an embodiment, the present invention is directed to an apparatus capable of opening capped and corked bottles comprising:

a first piece comprising a corkscrew with a point at one end and a bottle opener with a slot capable of receiving a rigid object at the opposite end; and a second piece comprising a flexible strand which is connected to a keyring;

wherein the first piece is connected to the second piece through the flexible strand and the first piece and the second piece of the apparatus can be arranged in at least two modes comprising;

a first mode (storage mode or capped bottle opener mode) wherein the flexible strand portion of the second piece is wound around the corkscrew portion of the first piece such that the corkscrew point is shielded; and a second mode (corked bottle-opener mode) wherein the flexible strand portion of the second piece is unwound such that the second piece does not interfere with use of the corkscrew.

In another embodiment, the present invention is directed to an apparatus capable of opening capped and corked bottles comprising:

a first piece comprising a corkscrew with a point at one end and a bottle opener with a slot capable of receiving a rigid object at the opposite end; and a second piece comprising a flexible strand is connected to a keyring;

wherein the first piece is connected to the second piece through the flexible strand and the first piece and the second piece of the apparatus can be arranged in at least two modes comprising;

a first mode (the storage mode and/or capped bottle opener mode) wherein the flexible strand portion of the second piece is wound around the corkscrew portion of the first piece such that the corkscrew point is shielded; and a second mode (the corked bottle-opener mode) wherein the flexible strand portion of the second piece is unwound such that the second piece does not interfere with use of the corkscrew and a rigid object is inserted into the slot capable of receiving a rigid object.

In an embodiment of the apparatus, the second piece may further comprise a rigid object connected to the key ring. When the apparatus further comprises the rigid object, in the second mode the rigid object may be inserted into the slot capable of receiving a rigid object. When the corkscrew is inserted into a cork and the rigid object is inserted into the slot capable of receiving a rigid object, the rigid object may serve as a handle allowing a user to screw the corkscrew into the cork and then pull the cork out of the wine bottle.

The term "slot capable of receiving a rigid object" is not intended to limit the utility of this slot to the insertion of rigid objects, as non-rigid object can also be inserted into this slot by the user. For example, this slot may be used to hold non rigid objects should the user desire.

In an embodiment of the apparatus, the second piece may further comprise a key connected to the key ring. When the apparatus further comprises a key, in the second mode the key may be inserted into the slot capable of receiving a rigid object. When the corkscrew is inserted into a cork and the key is inserted into the slot capable of receiving a rigid object, the key may serve as a handle allowing a user to screw the corkscrew into the wine cork and subsequently pull the cork out of the wine bottle.

In an embodiment, the flexible strand is connected to the bottle opener portion of the first piece. The flexible strand may be wound around the cork in the first mode, or it may be unwound to free the corkscrew for use in opening a corked bottle. In the first mode, the apparatus can be stored or it can be used to open capped bottles. The flexible strand may be sufficiently stiff as to prevent inadvertent unwinding of the flexible strand when stored in the first mode. The flexible strand should be sufficiently flexible such that is can be unwound from the first mode to the second mode by hand. The flexible strand may be a single strand or it may be constructed from more than one strand. In an embodiment, the flexible strand may be a single strand, a double strand, or a triple strand. In certain embodiments, the flexible strand may be a rope, a chain, a wire, or a cord.

In an embodiment, in the first mode the corkscrew point is sufficiently shielded as to prevent it from puncturing fabric when stored in, for example, a pocket or handbag. In an embodiment, the flexible strand itself may be wound around the corkscrew such that the flexible strand partially or fully shields the point of the corkscrew.

In certain embodiments, the shielding may be provided by the flexible strand itself, a structure that is connected to the flexible strand, the structure of the key ring, or a combination thereof. In other embodiments, in the first mode the keyring is positioned such that it partially or fully shields the point of the corkscrew.

In an embodiment, the strand may include a knot at one end that shields the tip of the corkscrew when it is stored. In another embodiment, the end of strand, when made from materials such as cord or rope, may be whipped, or fused to form a structure that shields the tip of the corkscrew when stored. In another embodiment, the strand may include a plug structure attached to the strand that shields the tip of the corkscrew when it is wound for storage. In an embodiment, the plug may be of sufficient size for printing words or a picture. For example, the plug may be of sufficient size to accommodate printing of a corporate logo or other branding.

In the second mode, the stand is unwound so that the corkscrew can be screwed into a wine cork and the wine cork can be pulled out. The bottle cap opener can also be used in either the first or second modes. In this mode, the rigid object, including a key, may be inserted into the slot capable of receiving a rigid object.

In an embodiment, for the slot capable of receiving a rigid object, the rigid object may be a key. The key may be connected to the key ring of the apparatus. The slot capable of receiving a rigid object may have an internal tapered shape capable of receiving keys of varying thicknesses.

In an embodiment, for the slot capable of receiving a rigid object, the rigid object may be a tool bit, for example, a tool bit connected to the key ring. The slot capable of receiving a rigid object may have an internal shape capable of receiving a tool bit. The tool bit may be, for example, a hex bit, which may be connected to the key ring. In an embodiment of the second mode, the hex bit is inserted into the slot capable of receiving a rigid object.

In an embodiment, the first piece comprising the corkscrew and capped bottle opener may be constructed from one or more materials selected from, for example, metal, plastic, and fiber.

The apparatus of the current invention has the further advantage that it is compact and can be readily stored in the user's pocket. When configured for storage, the maximum length of the apparatus of the present invention is in certain embodiments no longer than 5 inches, no longer than 4 inches, no longer than 3 inches, no longer than 2 inches, or no longer than 1.5 inches.

Further objects of the invention are shown in the figures described in detailed description, but these sections are not intended to be illustrative and not explicitly limit the invention.

4. BRIEF DESCRIPTION OF THE FIGURES

FIG. 1 provides an illustration of the combination corkscrew, bottle opener, and key ring apparatus, with key, arranged in the first mode.

Figure 2:
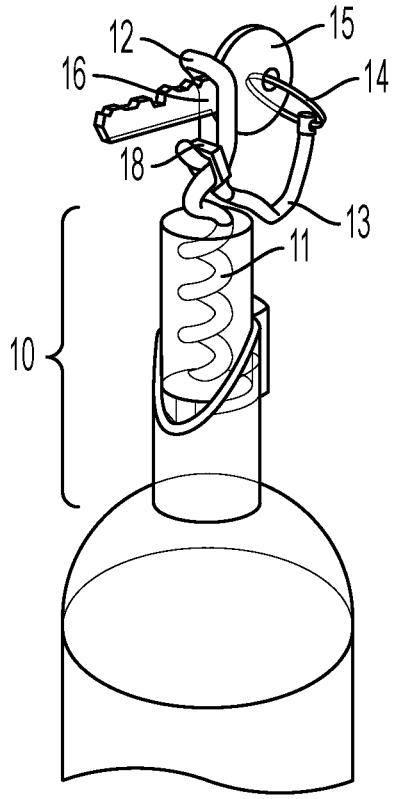

FIG. 2 provides an illustration of the first mode of the combination corkscrew, bottle opener, and key ring apparatus, with key, arranged in the second mode opening a corked bottle by screwing into the cork and pulling the cork from the bottle.

Figure 3:
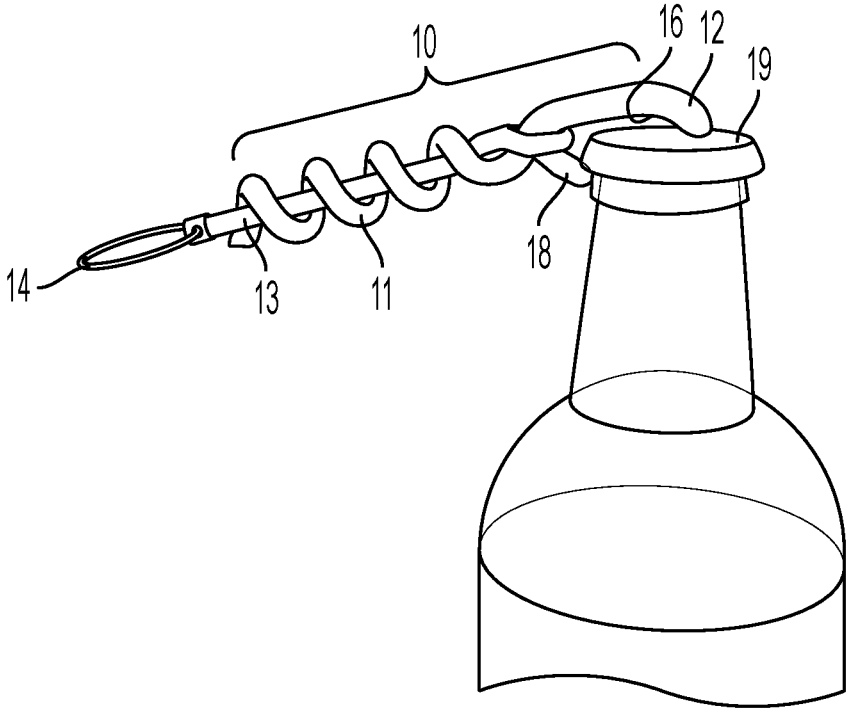

FIG. 3 provides an illustration of the combination corkscrew, bottle opener, and key ring apparatus arranged in the first mode opening a capped bottle.

Figure 4:
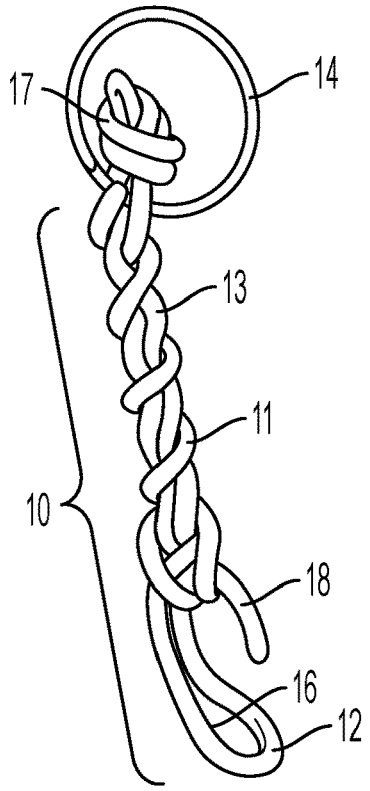

FIG. 4 provides an illustration of the combination corkscrew, bottle opener, and key ring apparatus, with key, arranged in the first mode for storage.

Figure 5:
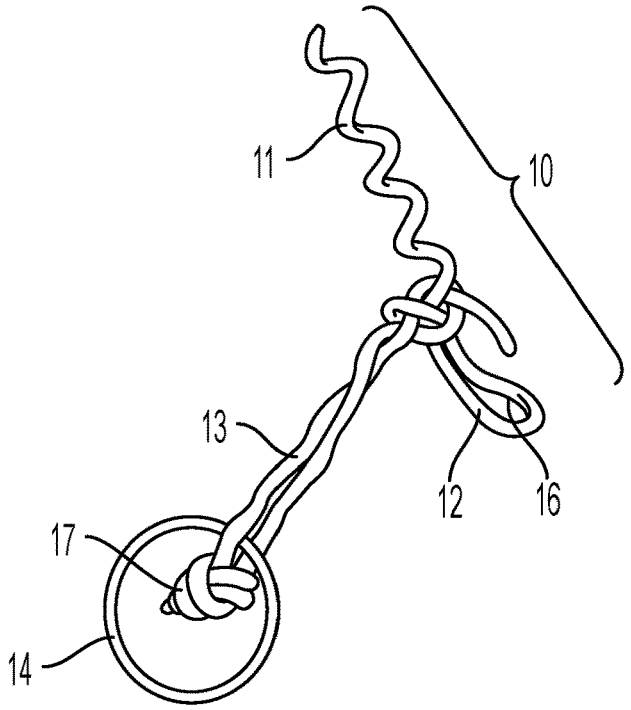

FIG. 5 provides an illustration of the combination corkscrew, bottle opener, and key ring apparatus, with key, arranged in the second mode unwound such that the second piece does not interfere with the potential use of the corkscrew.

5. DETAILED DESCRIPTION

The present invention is generally directed to a compact pocket-sized combination corkscrew, bottle cap opener, and key chain apparatuses that can readily be transported by the user on a daily basis. The Figures provide illustrative depictions of the present invention in various configurations to show their structures and utility, but these figures are not intended to be limiting of the invention. The combination apparatus is capable of opening both corked and capped bottles and is designed so that it is light and of a size that is amenable for easy transport. The apparatus is also designed to shield the tip of the corkscrew from being exposed and free to puncture materials, including fabric, when the apparatus is stored for transport.

As annotated in FIGS. 1-5, the corkscrew and bottle cap opener piece, 10, can be crafted from a single piece of unified material or as multiple pieces of the same or different materials assembled together into a single body. The corkscrew, 11, is positioned on one end of the body and the opposing end of this body includes the bottle cap opener, 12, such that the tip of the corkscrew is on the opposite end of the body as the outer edge of the bottle cap opener.

The corkscrew tip of 11 must be sufficiently sharp to pierce the cork of a wine bottle, and sufficiently strong to be screwed into the bottle cork and to pull out the cork, regardless of whether the wine cork is constructed from natural cork or synthetic materials.

The body of the combined corkscrew and bottle cap opener piece, 10, may be constructed from materials typically used to construct corkscrews and bottle cap openers, including, but not limited to metals, plastics, fibers, and combinations thereof. Such materials may include without limitation, iron, stainless steel, aluminum and aluminum alloys, titanium, and carbon fiber, provided the materials used to construct the body are sufficiently strong to withstand the forces required to remove a cork from a wine bottle with the corkscrew, 11, and a cap from a capped bottle with the bottle cap opener, 12.

The body of 10 should be of size and weight so that it can be readily transported in a pocket or handbag. In an embodiment, 10, as measured from the tip of the corkscrew to the outer edge of the bottle cap opener should be of a length no longer than 5 inches, no longer than 4 inches, no longer than 3 inches, no longer than 2 inches, no longer than 1.5 inches, or no longer than 1 inch. In an embodiment, 10, as measured from the tip of the corkscrew to the outer edge of the bottle cap opener should be of a length of from about 1 inch to about 5 inches, from about 1 inch to about 4 inches, from about 1 inch to about 3 inches, from about 1 inch to about 2 inches, or from about 1 inch to about 1.5 inches. In an embodiment, 10, as measured from the tip of the corkscrew to the outer edge of the bottle cap opener should be of a length of from about 1 inch to about 5 inches, from about 1.5 inches to about 4 inches, from about 1.5 inches to about 3 inches, from about 1.5 inches to about 2 inches. In an embodiment, 10, as measured from the tip of the corkscrew to the outer edge of the bottle cap opener should be of a length of from about 2 inches to about 5 inches, from about 2 inches to about 4 inches, or from about 2 inches to about 3 inches.

The corkscrew, 11, can be of a type of corkscrew typically used to open corked bottles. In an embodiment, the corkscrew, 11, is a wire helix. Wire helix corkscrews, include, without limitation, wire helix, cyphered wire helix and grooved wire helix corkscrews.

When used to open a capped bottle, the bottle cap opener 12, has an outer edge, 19, that goes on the top of the bottle cap as shown in FIG. 3, while a lower lip, 18, goes below the bottom edge of the bottle cap to provide leverage to pry open and remove the bottle cap. The bottle cap opener, 12, also includes a slot, 16, through which a rigid object can be inserted.

The slot, 16, may a uniform size, so that it is designed to accommodate a specific rigid object or it may tapered so that objects of varying sizes and/or thicknesses can be accommodated. In order to facilitate the use of corkscrew feature of the apparatus, the rigid object should be able to fit snugly within the slot in the bottle cap opener. The size of the slot, 16, may be determined by the type of rigid object intended to be inserted. For example, the slot, 16, could be sized such that a standard key may fit snugly inside the slot (FIG. 2). Alternatively, the slot, 16, may be designed to fit rod or tool bit (e.g., a hex key) snugly inside the slot.

To the body of the corkscrew and bottle cap opener, 10, is connected a strand, 13. In an embodiment, the strand may be connected to the bottle cap open portion, 12, of 10. For example, as shown in the figures, the strand 13 can be tied around bottle cap opener adjacent to its lower lip, 18. The strand, 13, can be wound around the corkscrew 11 in the first mode for storage (FIGS. 1 and 4), or when the apparatus is used to open capped bottles (FIG. 3).

The strand, 13 should be sufficiently stiff so that it does not come unwound when stored or used to open capped bottles. The strand, 13, should also be readily unwound and wound by hand when going from the first mode to second mode and back to the first mode. Exemplary materials for constructing the strand, 13, include wire and nylon cord. The strand, 13, may be made from a material that allows the selection of different colors or designs.

In the first mode, the pointed tip of the corkscrew, 11, should be shielded. The strand 13, itself may be sufficient to shield the pointed tip of the corkscrew. The end of the strand, 13 may be knotted to form a knot structure, 17, that shields the pointed tip of the corkscrew (FIG. 4) in the first mode. Alternatively, the strand, 13, may be, for example, whipped (a process by which the end of a cord or rope is tied off with twine) or fused (a process by which the end of a cord or rope is melted) to form a structure that can shield the tip of the corkscrew, 11. As another alternative, a plug structure may be attached to the end of the strand, 13, such that the plug structure can shield the tip of the corkscrew in the first mode. The plug structure may be made from, for example, plastic, wax, wood, cork, resin, leather, or gel.

In the second mode, the strand, 13, is unwound so that the corkscrew, 11, is free and can be inserted and screwed into a bottle cork (FIGS. 2 and 5).

The apparatus also contains a key ring 14 connected to the strand, 13. A key, 15, may be optionally attached to the key ring, 14 (FIGS. 1 and 2). To the key ring, 14, other optional structures may be attached, including rigid objects such as tool bits, for example, hex key.

The strand itself, 13, may be made from a single strand, multiple separate strands, or a single strand that when attached to 10 forms multiple connected strands. For example, FIGS. 4 and 5 provide an example where the strand, 13, is tied around the capped bottle opener, 12, in a manner that provides a double strand that is knotted at one end, 17, where the knot shields the tip of the corkscrew, 11, in the first mode (FIG. 4). In this particular exemplary apparatus, the strand, 13, is a nylon cord, but it could also be made of other materials. In this particular apparatus the key ring 14, is remains fastened to the strand, 13, because of the presence of the knot, 17.

Keys or other rigid objects may be suitable to insert through the slot capable of receiving a rigid object, 16, when the apparatus is used in its second mode for opening corked bottles (FIG. 2). The strand, 13, should be sufficiently long so that the rigid object attached to the key ring, 14, can be inserted into the slot 16 (FIGS. 2 and 5). This feature allows the apparatus to go between the first (FIG. 4) and second (FIG. 5) modes, and be used for opening a corked bottle (FIG. 2), without the need for disassembly and reassembly.

The slot, 16, may be designed specifically to accommodate rigid objects of particular sized and shapes. The slot, 16, may be designed to have a shape capable of receiving a key (FIG. 2). The shape may be tapered such that the slot, 16, may accommodate keys of different thicknesses. For example, the slot, 16, may be designed to have a hexagonal shape that is capable of receiving a hex key of a specific size.

It is preferred that the rigid object, whether it is a key, 15, or another rigid object (e.g., a tool bit, rod, hex key, etc.) fits snugly within the slot, 16. This will allow the user of the apparatus to have leverage when screwing the corkscrew, 11, into a corked bottle as well as when pulling the corkscrew out of the bottle, as depicted in FIG. 2.

The foregoing description conveys the best understanding of the features, objectives, and advantages of the present invention. Different embodiments, however, may be made of the inventive concept of this invention. The embodiments disclosed herein are intended to be understood as illustrative, but not intended to limit the invention to only those embodiments explicitly recited.

The invention claimed is:

1. An apparatus capable of opening capped and corked bottles comprising:

a first piece comprising a corkscrew with a point at one end and a bottle opener with a slot capable of receiving a rigid object at the opposite end; and a second piece comprising a flexible strand connected to a keyring;

wherein the first piece is connected to the second piece through the flexible strand and the first piece and the second piece of the apparatus can be arranged in at least two modes comprising;

a first mode wherein the flexible strand portion of the second piece is wound around the corkscrew portion of the first piece such that the corkscrew point is shielded; and a second mode wherein the flexible strand portion of the second piece is unwound such that the second piece does not interfere with use of the corkscrew.

2. The apparatus of claim 1, wherein the second piece further comprises a key connected to the key ring.

3. The apparatus of claim 2, wherein in the second mode the key is inserted into the slot capable of receiving a rigid object.

4. The apparatus of claim 1, wherein the flexible strand is connected to the bottle opener portion of the first piece.

5. The apparatus of claim 1, wherein the flexible strand is sufficiently stiff as to prevent inadvertent unwinding of the second piece when stored in the first mode, further wherein the flexible strand is sufficiently flexible such that is can be unwound from the first mode to the second mode by hand.

6. The apparatus of claim 1, wherein in the first mode the corkscrew point is sufficiently shielded as to prevent it from puncturing fabric.

7. The apparatus of claim 1, wherein in the first mode the keyring is positioned such that it partially or fully shields the point of the corkscrew.

8. The apparatus of claim 1, wherein in the first mode the flexible strand is wound around the corkscrew such that the flexible strand partially or fully shields the point of the corkscrew.

9. The apparatus of claim 1, wherein the slot capable of receiving a rigid object has an internal tapered shape capable of receiving keys of varying thicknesses.

10. The apparatus of claim 1, wherein the flexible strand is a rope, a chain, a wire, or a cord.

11. The apparatus of claim 1, wherein the first piece is constructed from one or more materials selected from metal, plastic, and fiber.

12. The apparatus of claim 1, wherein the second piece further comprises a hex bit connected to the key ring.

13. The apparatus of claim 12, wherein in the second mode the hex bit is inserted into the slot capable of receiving a rigid object.

14. The apparatus of claim 1, wherein the slot capable of receiving a rigid object has an internal shape capable of receiving a tool bit.

15. An apparatus capable of opening capped and corked bottles comprising:

a first piece comprising a corkscrew with a point at one end and a bottle opener with a slot capable of receiving a rigid object at the opposite end; and a second piece comprising a flexible strand connected to a keyring;

wherein the first piece is connected to the second piece through the flexible strand and the first piece and the second piece of the apparatus can be arranged in at least two modes comprising;

a first mode wherein the flexible strand portion of the second piece is wound around the corkscrew portion of the first piece such that the corkscrew point is shielded; and a second mode wherein the flexible strand portion of the second piece is unwound such that the second piece does not interfere with use of the corkscrew and a rigid object is inserted into the slot capable of receiving a rigid object.

* * * * *